United States Patent [19]

Shimizu

[11] Patent Number: 4,600,555

[45] Date of Patent: Jul. 15, 1986

[54] METHOD OF PRODUCING A CYLINDRICAL PERMANENT MAGNET

[75] Inventor: Motoharu Shimizu, Kumagaya, Japan

[73] Assignee: Hitachi Metals, Ltd., Tokyo, Japan

[21] Appl. No.: 610,499

[22] Filed: May 15, 1984

[30] Foreign Application Priority Data

May 20, 1983 [JP] Japan ..... 58-88962

[51] Int. Cl.[4] ..... B22F 3/16; B22F 3/24

[52] U.S. Cl. ..... 419/5; 419/26; 419/38; 419/44; 335/302

[58] Field of Search ..... 428/928; 419/56, 38, 419/44, 55, 26; 29/DIG. 28, DIG. 95, 607, 608; 335/302

[56] References Cited

U.S. PATENT DOCUMENTS 3,114,715 12/1963 Brockman .
4,057,606 11/1977 Kobayashi et al. .

FOREIGN PATENT DOCUMENTS 74907 6/1981 Japan .
37803 3/1982 Japan .
128909 8/1982 Japan .
130407 8/1982 Japan .
199205 12/1982 Japan .
1230815 5/1971 United Kingdom ..... 428/928

*Primary Examiner*—Allan M. Lieberman
*Attorney, Agent, or Firm*—Finnegan, Henderson, Farabow, Garrett & Dunner

[57] ABSTRACT

A method of producing a cylindrical permanent magnet having a multipole surface anisotropy. The method comprises the steps of: preparing a metal mold cooperating with a lower punch in defining therein a cylindrical compacting cavity, the metal mold being provided in the inner peripheral surface thereof with field coils corresponding in number to the number of the magnetic poles of the magnet to be produced; charging the compacting cavity with a ferromagnetic powder having a magnetic anisotropy; energizing the field coils to impart a magnetic anisotropy to the ferromagnetic powder while compacting the powder between an upper punch and the lower punch to form a compact; demagnetizing the formed compact followed by a firing; and magnetizing the fired compact in the same direction as the anisotropy. The method is characterized in that the field coils produce pulse magnetic field the intensity of which is not smaller than $3.5\times10^3$ ampere-turn/m when measured at the outer peripheral surface of the compacting cavity, thereby attaining a multipole surface anisotropy on the compact.

8 Claims, 11 Drawing Figures

METHOD OF PRODUCING A CYLINDRICAL PERMANENT MAGNET

BACKGROUND OF THE INVENTION

The present invention relates to a method of producing an anisotropic cylindrical magnet by compacting a ferromagnetic powder in a magnetic field.

Nowadays, dynamic electric machines such as generators, motors and so forth incorporating permanent magnets find various uses such as a motor for driving the magnetic disk of a computer and a motor for controlling the printer attached to the computer. For such uses, a motor called "PM type of stepping motor", having a rotor constituted by a multipole cylindrical permanent magnet, is most suitably used. In fact, there is an increasing demand for this type of motor, because of its excellent controllability. Usually, the cylindrical permanent magnet used in this motor has four or more poles, and rotors having magnetic poles greater than 8, e.g. 12, 24 or 36 poles, are becoming popular.

Hitherto, isotropic ferrite magnets have been used most popularly as the cylindrical permanent magnet of the kind described. This magnet, however, cannot provide satisfactory magnetic properties. For instance, a cylindrical permanent magnet of this type, having 24 poles and being 26 mm in outside diameter, exhibits a surface magnetic flux density Bo which is as small as 900 to 950 G. A radially anisotropic ferrite magnet, produced by a process making use of rolling induced anisotropy, is proposed in, for example, U.S. Pat. No. 4,057,606. This magnet also shows unsatisfactory magnetic properties due to the use of a binder agent for rolling and winding. For instance, a cylindrical permanent magnet of this type, having 24 poles and being 26 mm in outside dia., shows only a small surface magnetic flux density Bo of 950 to 1050 G.

Under these circumstances, the present invention aims as its primary object at providing a cylindrical permanent magnet having excellent magnetic properties to obviate the problems of the prior art.

As a cylindrical permanent magnet for the PM type of stepping motor, a cylindrical permanent magnet having multipole anisotropy is only required on its surface (see Japanese Patent Application Laid-Open Publication No. 199205/82).

On the other hand, various methods have been proposed for producing cylindrical permanent magnet having radial anisotropy. Examples of such methods are shown, for example, in Japanese Patent Application Laid-Open Publication No. 74907/81 or Japanese Patent Application Laid-Open Publication No. 98402/81. However, almost no study has been made up to now as to production methods for producing a permanent magnet having multipole surface anisotropy, and the present applicant is the only firm which is known to produce this type of magnet on a mass production basis.

The term "surface anisotropy" is used in this specification to mean such a state that the axes of easy magnetization are arrayed along the line (usually an arc) which connects the poles of opposite polarities existing on a same surface, e.g. the outer peripheral surface, of the cylindrical compact or magnet.

It has been thought that a permanent magnet having surface anisotropy may be produced by compacting conducted under the influence of a magnetic field. This method, however, cannot provide sufficiently high magnetic properties and tends to cause non-uniformity of the magnetic flux density along the length of each magnetic pole, unless a special compacting method is employed. In this type of permanent magnet, slight fluctuation in magnetic flux density (of the order of 2% or less) along the length of the magnetic pole does not matter substantially and, hence, is acceptable.

SUMMARY OF THE INVENTION

Accordingly, it is an object of the invention to provide a production method for producing a cylindrical permanent magnet with surface anisotropy while ensuring superior magnetic properties and high uniformity of the magnetic flux density along the length of the magnetic poles, thereby to obviate the above-described shortcomings of the prior art.

To this end, according to one aspect of the invention, there is provided a method of producing a cylindrical permanent magnet comprising the steps of: preparing a metal mold cooperating with a lower punch in defining therein a cylindrical compacting cavity, the metal mold being provided with a magnetic field means corresponding to the magnetic poles of the magnet to be produced; charging the compacting cavity with a ferromagnetic powder having magnetic anisotropy; energizing the magnetic field means to impart magnetic anisotropy to the ferromagnetic powder while compacting the powder between an upper punch and the lower punch to form a compact; demagnetizing the formed compact followed by a firing; and magnetizing the fired compact in the same direction as the imparted anisotropy; characterized in that the magnetic field means produce a pulse magnetic field the intensity of which is not smaller than $3.5\times10^3$ ampere-turn/m as measured at the outer peripheral surface of the compacting cavity, thereby attaining multipole surface anisotropy on the compact.

The above and other objects, features and advantages of the invention will become clear from the following description of the preferred embodiments when the same is read with reference to the accompanying drawings.

DESCRIPTION OF THE PREFERRED EMBODIMENTS

Figure 1:
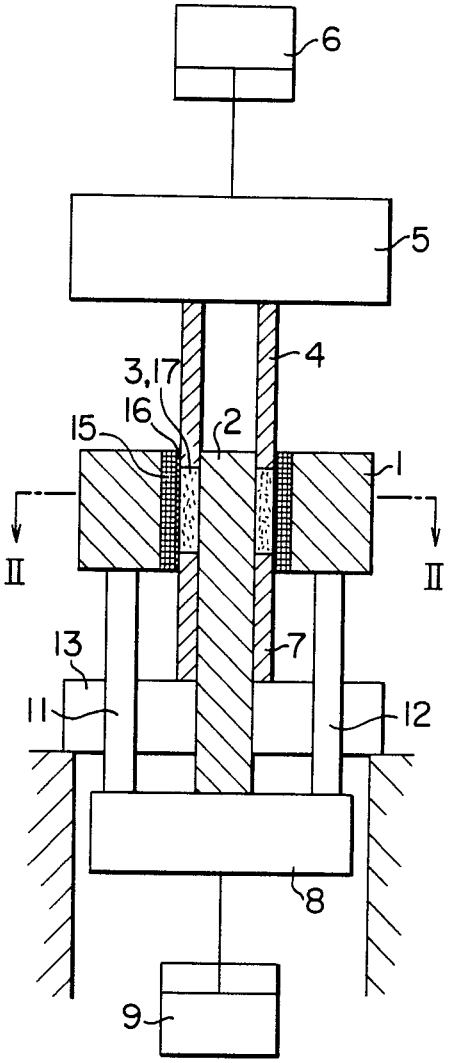
FIG. 1 is a vertical sectional view of an example of a compacting apparatus suitable for use in carrying out the method of the invention.
Figure 2:
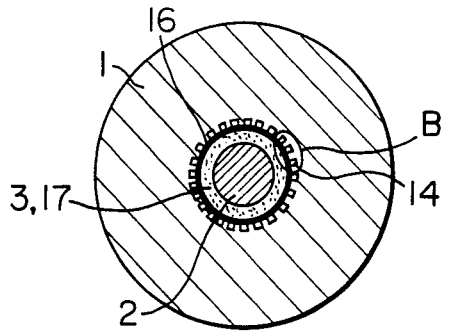
FIG. 2 is a sectional view taken along the line II—II of FIG. 1.

Referring first to FIGS. 1 and 2, a die 1 made of a magnetic material is fixed to the lower frame 8 through pillars 11 and 12, while a core 2 made of a non-magnetic material is connected directly to the lower frame 8 which would be driven by a lower hydraulic cylinder 9. An upper punch made of a non-magnetic material and supported by an upper frame 5 is disposed to project into the upper end portion of the die 1. A hydraulic cylinder 6 receives a piston having a rod which is connected to the upper frame 5. On the other hand, a lower punch 7 made of a non-magnetic material is fixed to a base plate 13, and would be projected partially into the lower end portion of the die 1. The die 1, core 2, upper punch 4 and the lower punch 7 in combination constitute a metal mold having a compacting cavity 3 defined therein. The compacting cavity 3 is adapted to be charged with a ferro-magnetic powder 17. As will be clearly seen from FIG. 2, a plurality of axial slots 14 are formed in the inner peripheral surface of the die 1 defining the compacting cavity 3. The number of the slots 14 is equal to the number of the magnetic poles to be formed, which is usually 8 (eight) or greater. Each slot 14 receives wires of coils for producing magnetic fields, as will be seen from FIG. 3. A ring-shaped spacer 16 made of a non-magnetic material is fitted on the inner peripheral surface of the die 1.

A cylindrical permanent magnet is produced by a method which will be explained hereinunder with specific reference to FIG. 1, using the apparatus described hereinbefore.

The upper punch 4 is lifted and cavity 3 is charged with a ferromagnetic powder 17 such as powder of an Nd-Fe-B alloy, powder of alloy of rare earth metal and Co, Sr-ferrite powder or the like, by means of a suitable feeding device such as a vibration feeder. Then, the pulse electric current is applied to the coil 15 (referred to as a "field coil," herefter) for producing a magnetic field to magnetically orientate the ferromagnetic powder 17. Subsequently, the upper punch 4 is driven downwardly to compact the ferromagnetic powder 17 onto a cylindrical compact, while applying pulse electric current to the field coil 15. While maintaining the pressure on the compact, the pulsed electric current (the direction of which is the reverse to that of the electric current supplied first) is then applied to the field coil 15 to demagnetize the cylindrical compact. After being removed from the metal mold, the cylindrical compact is fired or sintered and is processed into the desired size. Finally, the cylindrical compact is magnetized in the same direction as the magnetic anisotropy, so that a cylindrical permanent magnet having multipole surface anisotropy is obtained.

The aforementioned production method has been extensively investigated, and as a result it was found that a cylindrical permanent magnet having superior magnetic properties and uniformity of magnetic flux density in axial direction (hereafter, referred to merely "linearity") can be obtained. Firstly, with reference to the magnetic properties of the permanent magnet to be obtained, a high magnetic field intensity Bg in the compacting cavity is indispensable for obtaining a large surface magnetic flux density Bo. However, if the number of the magnetic poles is increased (e.g. 24 poles or more), the volume of each slot 14 for receiving the field coil becomes smaller, so that the number of turns of coil which can be received in each slot is naturally limited to several turns. Accordingly, in order to obtain sufficiently high magnetic field intensity with field coils of such a small number of turns, it is necessary to increase the level of the electric current supplied to the field coils. For instance, if each field coil has two turns, it is necessary to supply a large electric current of 8,000 to 15,000 A in order to produce a magnetic field of $8\times10^3$ to $15\times10^3$ ampere-turn/meter. It would be practically impossible, however, to deal with such a large electric current in this type of apparatus unless suitable measures are taken to remove the heat which would be produced in the coil by the electric current. To obviate this problem, the present inventor has found that a permanent magnet having a surface magnetic flux density Bo of 1,500 G or greater can be obtained by supplying the field coil with a sufficient pulsed electric current so that the magnetic field intensity becomes $3.5\times10^3$ ampere-turn/meter or greater. In this case, the pulsed magnetic field may be applied not only one time but also several times.

Further, the construction of a magnetic circuit in the metal mold is important for attaining the required surface magnetic flux density Bo as mentioned above as well as the multipole surface anisotropy. Namely, from the view point of the magnetic properties, the metal mold shown in FIG. 3 having coil-receiving slots 14 formed directly in the inner peripheral surface of the die 1 is quite effective. However, the formation of a large number of slots for multipole encounters the following problem. Namely, when a large number of axial slots are formed in the inner peripheral surface of the die 1, the circumferential width of each land portion 1*a* separating adjacent slots 14 becomes extremely small. Such land portions having a small width may fail to withstand the large compacting pressure and may become rapidly worn down. The compacting pressure usually ranges between 0.5 and 1 ton/cm$^2$ and the lateral pressure acting on the die and the core falls within the range of 0.1 to 0.4 ton/cm$^2$ (Rankine coefficient assumed to be 0.2 to 0.4), in the case of production of the ferrrte type of cylindrical permanent magnet. The present inventor has found that this problem can be overcome by fitting a ring-shaped spacer 16 made of a non-magnetic material onto the inner peripheral surface of the metal mold. When the spacer is used, however, the intensity of effective magnetic flux reaching the surface of the compact is inconveniently decreased as the thickness t of the spacer is increased (in FIGS. 3 and 4, the chain line represents the path of magnetic flux). The thickness t, therefore, would be selected to meet the following condition:

$$t<\pi\cdot d/3\cdot M$$

where, d represents the inside diameter of the spacer, while M represents the number of magnetic poles.

Figure 3:
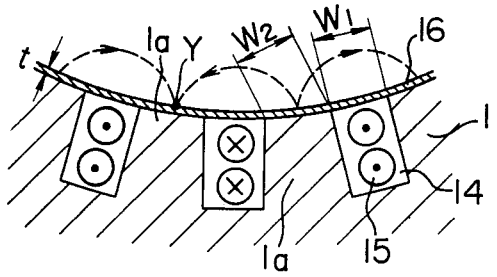
FIG. 3 is an enlarged view of the portion marked at B in FIG. 2.
Figure 4:
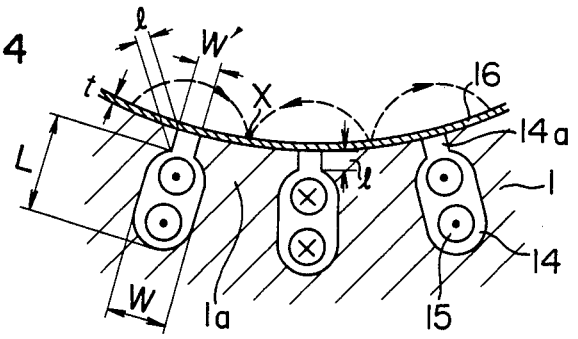
FIG. 4, shows a modification of the arrangement shown in FIG. 3.

FIG. 4 shows a modification of the coil-receiving slots 14. In this case, each slot 14 has a greater radial depth from the inner peripheral surface of the core than that in the construction shown in FIG. 3, and opens to the inside of the core 1 through a restricted opening 14*a*. Consequently, the land portion 1*a* between adjacent slots 14, constituting a magnetic pole, has a large circumferential width to exhibit greater mechanical strength and wear resistance. In order to minimize the reduction in the intensity of effective magnetic flux reaching the surface of the compact, the thickness t of the spacer 16 should be selected to meet the above-mentioned condition also in the construction shown in FIG. 4. In the construction shown in FIG. 4, the restricted opening 14*a* is preferably as small as possible, in order to attain higher mechanical strength and wear resistance of the land portion. In such a case, however, the magnetic flux will tend to short-circuit between the adjacent land portions to undesirably decrease the intensity of magnetic flux reaching the surface of the compact. It would be possible to eliminate this problem by supplying a large pulse electric current to the field coils to magnetically saturate the short-circuiting portion. Preferably, in FIGS. 3 and 4 after inserting the field coil 15 into the coil-receiving slot 14, the slot is filled with a reinforcing material such as an epoxy resin, composite filler or the like by means of, for example, vacuum impregnation, thereby increasing the strength and the wear resistance of the metal mold.

The application of the pulsed magnetic field can be made by connecting the field coil to, for example, an instantaneous D.C. power source having a transformer/rectifier for transforming and rectifying the commercial A.C. power into a D.C. voltage of, for example, about 700 V, the capacitors each having a capacitance of, for example, $4\times10^4$ $\mu$F and being adapted to be charged with the D.C. voltage and a thyristor through which the capacitor discharges.

High magnetic flux density and high uniformity or linearity of magnetic flux density along the length of the magnetic pole are the essential factors for attaining the desirable multipole surface anisotropy. The present inventor has found that a high linearity of the magnetic flux density can be obtained when the compacting is conducted in a manner mentioned below.

Figure 5:
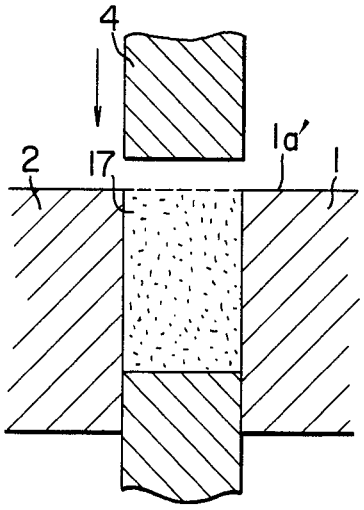
FIG. 5 is a sectional view of an essential part of a compacting apparatus before compacting a powder in a conventional compacting method.
Figure 6:
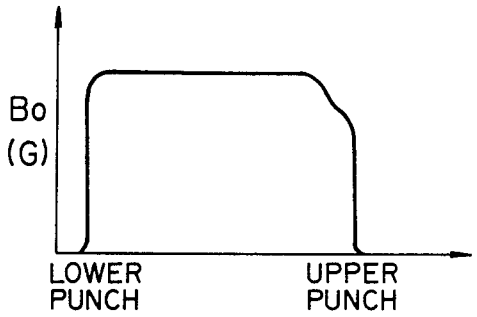
FIG. 6 is an illustration of the magnetic flux density distribution in a permanent magnet formed by the conventional compacting method as shown in FIG. 5.

In the ordinary compacting method, as shown in FIG. 5, the cylindrical compact is formed by putting the ferromagnetic powder 17 into the compacting cavity and driving the upper punch 4 downwardly to compact the ferromagnetic powder, while applying pulse magnetic field to impart anisotropy. As the magnetic flux between adjacent land portions on the upper end surface 1*a*′ of the die 1 is irregular, the anisotropy is decreased in the upper portion of the compact. FIG. 6 shows the axial magnetic flux density distribution on each magnetic pole of a cylindrical permanent magnet which is produced by subjecting the cylindrical compact formed by the method shown in FIG. 5 to firing and magnetization. As will be seen from this Figure, the anisotropy is decreased in the portion of the magnet near the upper punch, so that the linearity of the magnetic flux density is impaired.

Figure 7:
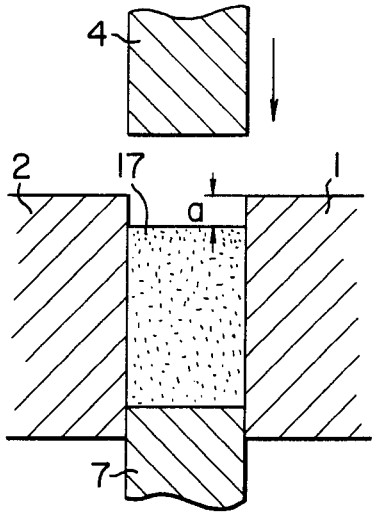
FIGS. 7 to 9 are sectional views of essential part of a compacting apparatus at each moment during the compacting according to the invention.

According to the invention, however, it is possible to eliminate such problem in the permanent magnet as shown in FIG. 5, by lifting the die 1 to form a vacant space of a height a as shown in FIG. 7 after charging the compacting cavity with the ferromagnetic powder 17 as shown in FIG. 5, before driving the upper punch 4 downwardly.

Figure 8A:
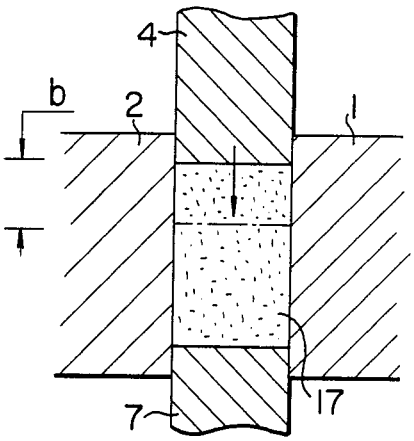
Figure 8B:
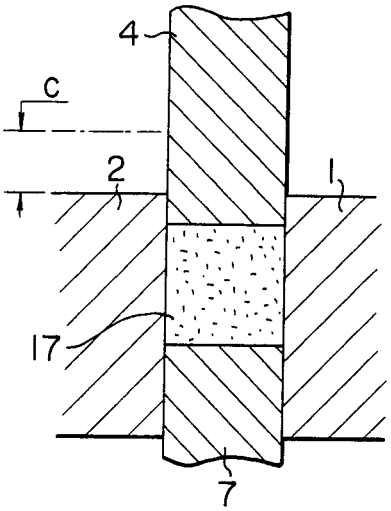

In order that the pulse magnetic field produced by the field coil is applied uniformly to the mass of ferromagnetic powder, it is advisable as shown in FIG. 8*b* to conduct the compacting while lowering the die 1 and the core 2 by a distance C which is substantially equal to the distance b (see FIG. 8*a*) travelled by the upper punch 4 after the latter is brought into contact with the ferromagnetic powder up to the completion of the compacting.

Figure 9:
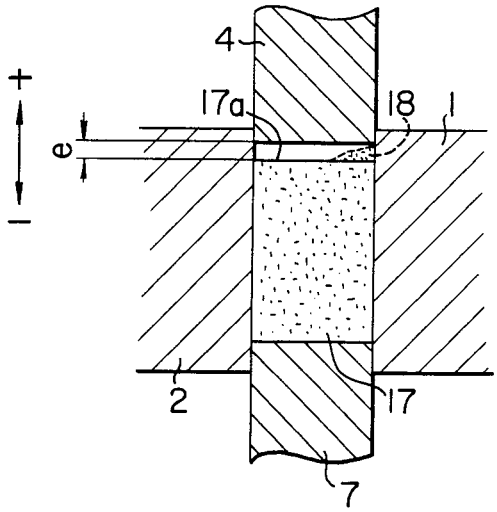

It is also advisable that the application of the pulsed magnetic field is conducted immediately after the commencement of contact of the upper punch 4 with the ferromagnetic powder. If the pulsed magnetic field is applied while a gap e is still left between the upper punch 4 and the ferromagnetic powder, as shown in FIG. 9 part 18 of the magnetic powder adjacent to the upper punch will be magnetically attracted to the die thereby disturbing the orientation. Incidentally, FIGS. 5 and 7 to 9 show the operation of the metal mold only schematically, so that the ring-shaped spacer and the magnetic coils are omitted from these Figures.

Although in the described embodiment the multipole anisotropy is given only to the outer peripheral surface of the cylindrical permanent magnet, this is not exclusive and, in some uses of the cylindrical permanent magnet, it is required to impart the multipole surface anisotropy to the inner peripheral surface of the cylindrical permanent magnet. It will be clear to those skilled in the art that the multipole anisotropy on the inner peripheral surface of the cylindrical permanent magnet can be attained by using a metal mold in which the core shown in FIG. 1 is made of a magnetic material and is provided with coil-receiving slots, with the similar magnetic circuit arrangement as that shown in FIGS. 2 to 4.

EXAMPLE 1

A ferromagnetic powder was prepared by adding 1 wt % of calcium stearate to Sr-ferrite powder having a mean particle size of about 1 $\mu$m. Using a compacting apparatus incorporating the metal mold as shown in FIG. 4, the powder was compacted at a pressure of 0.7 ton/cm$^2$ under the application of pulsed magnetic fields, and a cylindrical compact having an outside diameter of 40.8 mm, inside diameter of 29.1 mm and a length of 41 mm (density 2.8 g/cc) was obtained. After firing at 1200° C., this cylindrical compact was processed into a size of an outside diameter of 33 mm, inside diameter of 24 mm and length of 35 mm and was magnetized to have 24 poles thereby obtaining a cylindrical permanent magnet. In this case, the thickness t of the spacer 16, distance l between the inner peripheral surface of the die 1 and the coil-receiving slot 14, and the width W′ of the restricted opening of the slot were selected to be 0.5 mm, respectively. The width W and length L of the slot 14 were selected to be 2.7 mm and 5.5 mm, respectively.

Table 1 shows the result of a test conducted to seek for the relationship between the magnetic field intensity Bg at position X in FIG. 4 and the surface magnetic flux density Bo under various input currents to the field coils.

TABLE 1

| Bg (ampere-turn/m $\times 10^3$) | 2.8 | 3.5 | 4.0 | 4.7 | 5.3 |
|---|---|---|---|---|---|
| Bo (G) | 1400 | 1500 | 1580 | 1600 | 1600 |

From Table 1 above, it will be understood that a magnetic field intensity Bg of $3.5\times10^3$ ampere-turn/m is necessary for obtaining the surface magnetic flux density Bo of 1500 G or higher.

EXAMPLE 2

With the metal molds shown in FIGS. 3 and 4, a test was conducted by using various thicknesses of the spacer to seek for the relationship between the thickness t of the spacer and the magnetic field intensity Bg (at portion Y in case of FIG. 3, at position in case of FIG.

Figure 10:
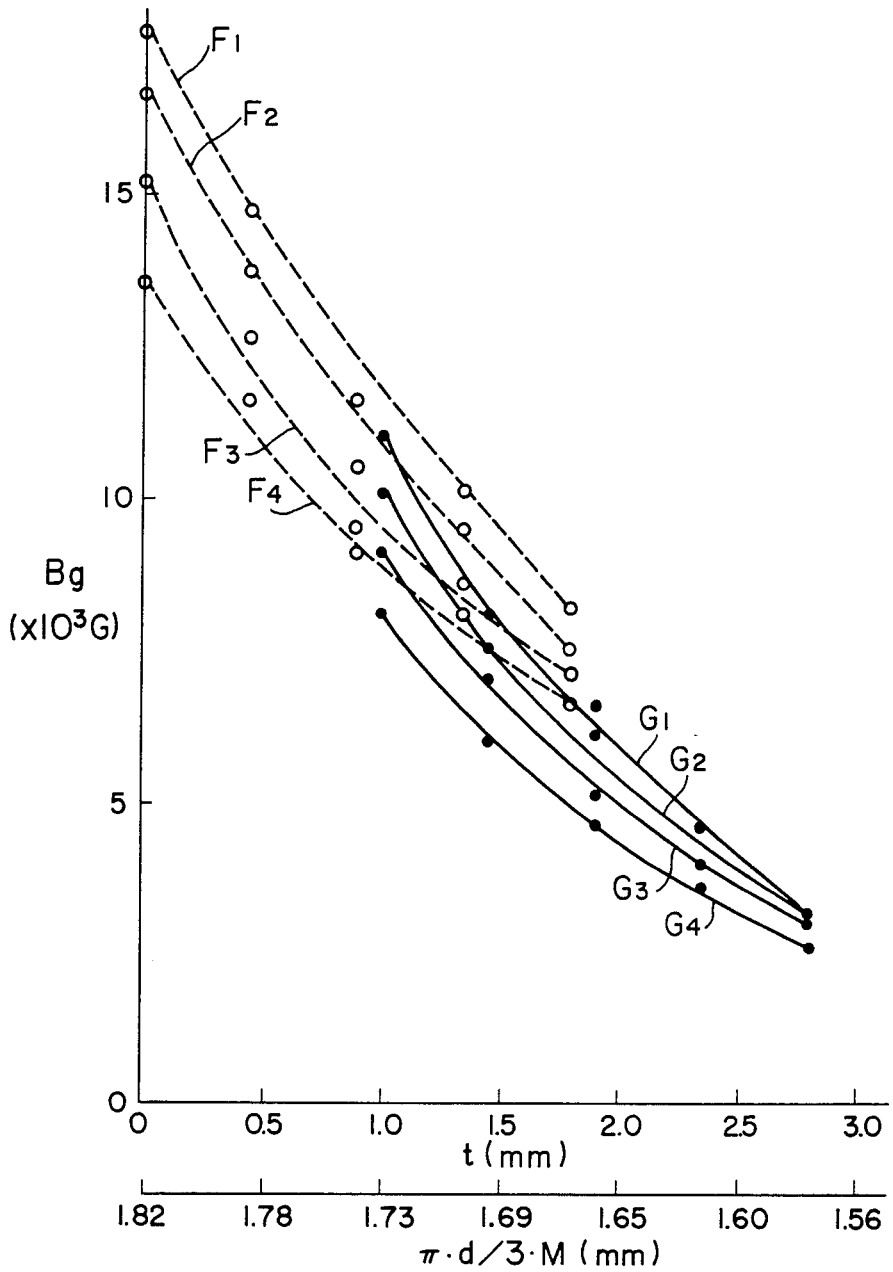
FIG. 10 is a graph showing the relationship between the magnetic field intensity Bg of a permanent magnet and the thickness of a spacer which is used in the production of the magnet.

4) and the result of which is shown in FIG. 10. The outside diameter of the spacer was 41.8 mm, while the number M of the magnetic pole was 24. In FIG. 10, the broken-line curves $F_1$ to $F_4$ show the results as obtained when the compacting is conducted with the metal mold shown in FIG. 3 (wherein $W_1=W_2$). The curve $F_1$ shows the result as obtained with the magnetomotive force of 4.42 (unit: $10^3$ ampere-turn). Similarly, the curves $F_2$, $F_3$ and $F_4$ show the results as obtained with the magnetomotive forces of 5.34, 6.27 and 7.22. Curves $G_1$ to $G_4$ show the results as obtained with the mold shown in FIG. 4 (wherein $W_1=W_2=5.5$ mm, $W_1'=0.5$ mm and $l=0.5$ mm). The curve $G_1$ was obtained when the magnetomotive force was selected to be 4.85 (unit: $10^3$ ampere-turn). Similarly, curves $G_2$, $G_3$ and $G_4$ correspond to magnetomotive force of 5.91, 6.94 and 8.00. As will be clearely understood from FIG. 10, the magnetic field intensity Bg is largely decreased when the thickness t of the ring-shaped spacer exceeds $\pi \cdot d/3 \cdot M$, so that the permanent magnet having the desired surface magnetic flux density Bo cannot be obtained.

EXAMPLE 3

With the arrangement and condition explained in connections with Example 1, a comparison was made between the case (a) where the pulse magnetic field was applied only before the commencement of compacting of the ferromagnetic powder and the case (b) where the pulse magnetic field was applied after the commencement of compacting of the ferromagnetic powder, and the results of which are shown in Table 3. The height a in the compacting cavity shown in FIG. 7 and the distance C shows in FIG. 8*b* were selected to be 20 mm at each case. The application of the pulse magnetic field was consecutively made for 5 times in each of the cases (a) and (b).

TABLE 3

| Magnetic field applying condition | Bo (G) Upper-punch side | Bo (G) (Center) | Bo (G) Lower-punch side | Finishing allowance of magnet after firing |
|---|---|---|---|---|
| (a) | 1627 | 1398 | 1631 | 1.0 mm |
| (b) | 1737 | 1738 | 1702 | 0.6 mm |

(Note)
Bg was maintained at $4.7 \times 10^3$ ampere-turn/m.

As shown in Table 3 above, it will be understood that preferably the application of the pulsed magnetic field could be conducted during the compacting for obtaining high linearity of the surface magnetic flux density.

EXAMPLE 4

Using the arrangement and conditions explained in connection with Example 1, the surface magnetic flux density Bo was measured while changing the height a in FIG. 7. The pulse magnetic field was applied consecutively 5 times during the compacting, at the intensity Bg of $4.7 \times 10^3$ ampere-turn/m and selecting the distance C shown in FIG. 8 to be 20 mm. The results of this test are shown in Table 4. The finishing allowance after the sintering was selected to be 1.3 mm in diameter in each case.

TABLE 4

| a (mm) | Bo (G) Upper-punch side | Bo (G) Lower-punch side |
|---|---|---|
| 0 | 1320 | 1650 |

TABLE 4-continued

| a (mm) | Bo (G) Upper-punch side | Bo (G) Lower-punch side |
|---|---|---|
| 2 | 1400 | " |
| 5 | 1600 | " |
| 10 | 1650 | " |
| 20 | 1650 | " |

As will be understood from Table 4, the value of surface magnetic flux density Bo in the upper-punch side is increased as the height a is increased, and becomes equal to that in the lower-punch side when the height a is increased to 10 mm or larger. From this fact, it will be understood that the linearity can be improved by raising the die again after filling up the compacting cavity with the ferromagnetic powder material.

EXAMPLE 5

Cylindrical permanent magnets were produced under the same conditions as Example 4 except that the height a shown in FIG. 7 was selected to be 20 mm and that the distance C in FIG. 8 was changed. The result of this test is shown in Table 5.

TABLE 5

| b (mm) | C (mm) | Bo (G) Upper-punch side | Bo (G) Lower-punch side |
|---|---|---|---|
| 40 | 0 | 1630 | 1670 |
| 35 | 5 | 1630 | 1670 |
| 30 | 10 | 1640 | 1660 |
| 20 | 20 | 1650 | 1650 |

As will be clearly understood from Table 5, the difference in the surface magnetic flux density Bo between the upper-punch side and the lower-punch side are decreased as the difference between the distance C and the downward stroke b of the upper punch becomes smaller. The difference in the surface magnetic flux density Bo between the upper-punch side and the lower-punch side becomes zero when the distance C becomes equal to the downward stroke b of the upper punch.

EXAMPLE 6

Cylindrical permanent magnets were produced under the same conditions as Example 5, except that the height a shown in FIG. 7 and the distance C shown in FIG. 8 were selected to be 20 mm and that the gap e shown in FIG. 9 was varied. The surface magnetic flux density Bo was measured to obtain the results shown in Table 6.

TABLE 6

| e (mm) | Bo (G) Upper-punch side | Bo (G) Lower-punch side |
|---|---|---|
| 5 | 1630 | 1650 |
| 0 | 1650 | " |
| −2 | 1650 | " |
| −5 | 1550 | " |
| −10 | 1400 | " |

As will be seen from Table 6 above, the surface magnetic flux density Bo in the upper-punch side of the magnet is disturbed as the size of the gap e is increased. It is, therefore, advisable to apply the pulse magnetic field almost simultaneously with the commencement of contact between the upper punch and the material powder.

Incidentally, the values of the surface magnetic flux density Bo in the described Examples are the mean of the values obtained for 24 magnetic poles.

As has been described, according to the invention, it is possible to obtain a cylindrical permanent magnet with multipole surface anisotropy, exhibiting superior magnetic properties and good linerarily in the surface magnetic flux density.

What is claimed is:

1. A method of producing a cylindrical permanent magnet comprising the steps of; preparing a metal mold cooperating with a lower punch in defining therein a cylindrical compacting cavity, said metal mold being provided in the inner peripheral surface thereof with a magnetic field means corresponding to the magnetic poles of the magnet to be produced; charging said compacting cavity with a ferromagnetic powder having magnetic anisotropy; energizing said magnetic field means to impart magnetic anisotropy to said ferromagnetic powder while compacting said powder between an upper punch and said lower punch to form a compact; demagnetizing the formed compact followed by a firing; and magnetizing the fired compact in the same direction as the imparted anisotropy; characterized in that said magnetic field means produce a pulsed magnetic field of an intensity not smaller than $3.5\times10^3$ ampere-turn/meter as measured at the outer peripheral surface of said compacting cavity, thereby attaining a multipole surface anisotropy on said compact.

2. A method of producing a cylindrical permanent magnet according to claim 1, wherein said compact has a multipole anisotropy of more than 8 (eight) poles.

3. A method of producing a cylindrical permanent magnet according to claim 1, wherein a ring-shaped spacer made of a non-magnetic material is fitted on the inner surface of said metal mold wherein the thickness t of said ring-shaped spacer is selected to meet the following condition:

$$t > \pi \cdot d/3 \cdot M$$

where, d represents the inside diameter of said spacer, while M represents the number of the poles.

4. A method of producing a cylindrical permanent magnet according to claim 1, wherein said metal mold is lifted by a predetermined amount after filling said compacting cavity with said ferromagnetic powder, and said pulsed magnetic field is applied after said upper punch is brought into contact with said ferromagnetic powder during its downward stroke.

5. A method of producing a cylindrical permanent magnet according to claim 1, wherein said ferromagnetic powder is compacted by both of said upper and lower punches by substantially equal amounts of compression.

6. A method of producing a permanent magnet according to claim 1, wherein said compact has an outside diameter of not smaller than 30 mm and is formed mainly of $MO.nFe_2O_3$, where M represents one, two or more of Ba, Sr and Pb, while n represents an integer which is 5 or 6.

7. A method of producing a cylindrical permanent magnet according to claim 1, wherein said cylindrical permanent magnet has a coercive force of 2 KOe or greater, and a reversible magnetic permeability of about 1.

8. A method of producing a cylindrical permanent magnet according to claim 2, wherein said cylindrical permanent magnet has a multipole anisotropy of 24 or more poles in the surface thereof.

* * * * *

UNITED STATES PATENT AND TRADEMARK OFFICE

CERTIFICATE OF CORRECTION

PATENT NO. : 4,600,555

DATED : July 15, 1986

INVENTOR(S) : MOTOHARU SHIMIZU

It is certified that error appears in the above-identified patent and that said Letters Patent is hereby corrected as shown below:

Claim 3, line 7, change "$t > \pi \cdot d/3 \cdot M$" to --$t < \pi \cdot d/3 \cdot M$--.

Signed and Sealed this

Twenty-first Day of October, 1986

[SEAL]

*Attest:*

DONALD J. QUIGG

*Attesting Officer*

*Commissioner of Patents and Trademarks*